United States Patent [19]

Omi

[11] Patent Number: 4,475,805

[45] Date of Patent: Oct. 9, 1984

[54] ELECTROPHOTOGRAPHIC COPYING APPARATUS

[75] Inventor: Kyoji Omi, Kawasaki, Japan

[73] Assignee: Ricoh Company, Ltd., Japan

[21] Appl. No.: 454,073

[22] Filed: Dec. 28, 1982

[30] Foreign Application Priority Data

Dec. 28, 1981 [JP] Japan ..... 56-210153

[51] Int. Cl.[3] ..... G03G 15/00

[52] U.S. Cl. ..... 355/8; 355/14 R; 355/3 R; 355/3 BE; 355/16; 355/55; 355/56

[58] Field of Search ..... 355/14 R, 3 R, 3 BE, 355/16, 55, 56, 8

[56] References Cited

U.S. PATENT DOCUMENTS

| | | | |
|---|---|---|---|
| 4,047,812 | 9/1977 | Hogan | 355/76 |
| 4,238,157 | 12/1980 | Strauch et al. | 355/55 X |
| 4,239,372 | 12/1980 | Iwai | 355/14 R |
| 4,277,165 | 7/1981 | Wada et al. | 355/55 |
| 4,284,344 | 8/1981 | Okamoto et al. | 355/14 CH X |

*Primary Examiner*—A. C. Prescott
*Attorney, Agent, or Firm*—Guy W. Shoup

[57] ABSTRACT

An electrophotographic copying apparatus includes a photosensitive member in the form of an endless belt having images of the document formed on its surface in a predetermined position by exposure to an optical image of the document while travelling. The photosensitive member has a peripheral length which includes a reserve when the photosensitive member is trained over a group of rollers without loosening, and is divided into a first section including a predetermined exposing position, a third section and a fourth section connected at one end thereof to opposite ends of the first section and accommodating the reserve in length by loosening the belt, and a second section connected to opposite ends to the other end of the third and fourth sections. At least one copying processing means other than a scanning and exposing means is located in the vicinity of the second section. The movement of the photosensitive member is controlled in such a manner that it is alternately moved in the first section at a high constant speed when scanning and exposing are carried out at a low constant speed or stopped when the scanning and exposing means is restored to its original position, and it is constantly moved in the second section at a constant speed intermediate between the two speeds at which it is alternately moved in the first section.

3 Claims, 11 Drawing Figures

ELECTROPHOTOGRAPHIC COPYING APPARATUS

BACKGROUND OF THE INVENTION

This invention relates to an electrophotographic copying apparatus comprising scanning and exposing means for effecting optical scanning of a document to expose a photosensitive member in the form of an endless belt (photosensitive belt for short) to an optical image of the document while the photosensitive belt is moving, so as to form images of the document in a predetermined position on the photosensitive belt.

Electrophotographic copying apparatus of the moving photosensitive member and slit exposure type include two types: one is a document moving and scanning type and the other is an image forming system moving and scanning type. In the former type, when it is desired to raise the duplicating speed (the number of copies produced per unit hour), it is necessary to shorten the return time or raise the return speed while the copying processing speed remains unchanged. However, this gives rise to problems with regard to displacement of the document and safety of the operator. Particularly when copying of the original is performed in a scale reducing mode, the speed at which scanning is effected should be raised and this involves danger.

To solve the aforesaid problems of the prior art, proposals have been made to use an apparatus provided with a sheet mode separately to raise the duplicating speed without expediting the movement of the document. However, this apparatus has no effect in solving the problems by a book type document when copying thereof is carried out.

In apparatus of the stationary document and moving image forming system type, the return time is wasted as is the case with apparatus of the moving document type. Thus it has hitherto been the usual practice to raise the return speed to increase the duplicating speed. However, an apparatus based on an entirely different concept has been proposed in which the duplicating speed is increased by increasing the number of copies produced while holding a latent image obtained by a single scanning and exposing operation for use to perform a prolonged copying operation. In this case, the conditions under which processing is effected would undergo changes, so that difficulties would be encountered in producing copies of high quality. Moreover, when the copies produced are small in size, there would be the disadvantage that the non-image forming section takes too long in view of the condition of using the closed loop photosensitive member, such as a photosensitive belt, and the processing elements.

When copying is performed in an enlarging or reducing mode by means of an electrophotographic copying apparatus of the slit exposure type, varying the magnification can be attained in a direction perpendicular to the slit, for example, by changing the speed of travel of the photosensitive member. However, when the speed at which the photosensitive member travels is changed in performing copying by using apparatus of the prior art, a change in the speed of travel of the photosensitive member of the exposing section inevitably results in a change in the speeds at which portions performing other processing than exposing move, thereby causing a change to occur in the processing conditions and making it impossible to obtain copies of high quality. An added disadvantage is that the copies show a variation in output speed depending on the magnification.

SUMMARY OF THE INVENTION

This invention has been developed for the purpose of obviating the aforesaid disadvantages of electrophotographic copying apparatus of the moving photosensitive member exposing type of the prior art. Accordingly the invention has as its object the provision of an electrophotographic copying apparatus of high reliability wich is capable of improving copying efficiency and energy efficiency without raising the scanning return speed, minimizing waste, and increasing the effective number of copies formed on the photosensitive member and the service life thereof. Specifically, the invention provides for increasing the image forming region ratio of the photosensitive member (the ratio of the length of the image region to the pitch of the image on the photosensitive member), keeping the speed of movement of the movable document support at a low level in the enlarging or reducing copy mode because of low scanning return speed when the apparatus is of the moving document type, in the interest of safety, and keeping the processing speed constant.

The aforesaid object is accomplished in the invention by providing the photosensitive belt with a peripheral length which includes a reserve when the photosensitive belt is trained over a group of rollers without any loosening; dividing the path of travel of the photosensitive belt into a first section including a predetermined exposing position, a third section and a fourth section connected at one end thereof to opposite ends of the first section and accommodating the reserve in length by loosening the belt, and a second section connected at opposite ends to the other end of the third section and the fourth section; and providing first drive means for driving the photosensitive belt for moving the photosensitive belt in the first section alternately at a high constant speed when scanning and exposing is carried out by scanning and exposing means and at a low constant speed or stopping same when the scanning and exposing means is returned to its original position, second drive means for moving the photosensitive belt in the second section at a constant speed intermediate between the two speeds of high constant speed and low constant speed, at least one duplication processing means other than the scanning and exposing means located around the second section, and control means for effecting control of the aforesaid means in a coordinated fashion, so that the aforesaid reserve in the length of the photosensitive belt has a value corresponding to the product of the difference between the speeds at which the photosensitive belt is driven to move in the first section and the second section when the scanning and exposing means is returned to its original position and the time required for the return trip thereof.

In an electrophotographic copying apparatus of the variable magnification type in which the scanning and exposing means comprises an image forming optical system for projecting an image of varied sizes of the document by keeping the surface of the document and the surface of the photosensitive belt in the exposing position in conjugate relation, it is possible to form images of varied size on the photosensitive belt equal in image forming intervals and reduced in the gap between the images by providing means for altering the speed of movement of the photosensitive belt within the exposing time depending on the magnification.

BRIEF DESCRIPTION OF THE DRAWINGS

FIG. 1(*b*) is a schematic view of images formed on the photosensitive member;

FIG. 2(*c*) is a diagram showing changes in the loosening of the photosensitive member in sections 3 and 4 in the apparatus according to the invention;

FIG. 3(*b*) is a schematic view of images formed on the photosensitive member;

DETAILED DESCRIPTION OF THE PREFERRED EMBODIMENTS

Figure 1A:
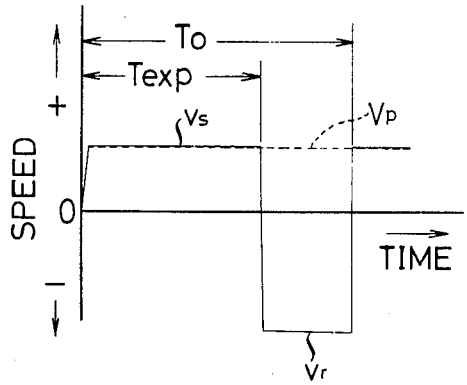
FIG. 1(*a*) is a diagram showing the speed of the scanning section and the speed of the photosensitive member in an apparatus of the prior art obtained when copying is effected in the same size as the document.
Figure 1B:
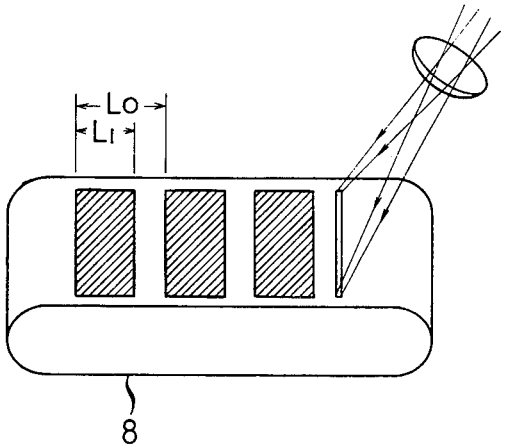

Before describing in detail the embodiments of the invention by referring to the accompanying drawings, the principle of the invention will be briefly described. FIG. 1(*a*) is a diagram showing the speed of the scanning section and the speed of the photosensitive member in an apparatus of the prior art obtained when copying is effected to produce copies of the same size as the document to be copied, and FIG. 1(*b*) is a schematic view of images formed on the sensitive member.

Let the exposing cycle, the exposing time, the scanning speed and the return speed be denoted by To, Texp, $v_s$ and $v_r$ rspectively and let the mean speed of $v_s$ and $v_r$ be denoted by $\bar{v}_s$ and $\bar{v}_r$ respectively. Then the following relation holds because the scanning distance and the return distance are equal:

$$\bar{v}_s \cdot Texp = \bar{v}_r (To - Texp) \quad (1)$$

Since copying is effected to produce copies of the same size as the document, the following relation also holds:

$$\bar{v}_s = V_p \quad (2)$$

Let the pitch of a latent image on the photosensitive member and the length thereof be denoted by Lo and $L_1$ respectively. Then the following relations hold:

$$Lo = V_p \cdot To \quad (3)$$

$$L_1 = Vp \cdot Texp \quad (4)$$

Therefore, $$Texp/To = L_1/Lo \quad (5)$$

$$\bar{v}_r = \frac{Texp}{To - Texp} \cdot v_s \quad (6)$$

Thus, to narrow the gap between the images on the photosensitive member, there is no alternative but to raise the return speed $\bar{v}_r$. One example will be described. Assume that To=0.9 second or 66.6 copies produced per minute, the copy length $L_1$=240 mm and the scanning speed $v_s$=400 mm/S. Then the following values can be obtained:

$$Texp = L_1/\bar{v}_s = 0.6 \text{ second}$$

$$\bar{v}_r = 800 \text{ mm/S}$$

$$Lo = 360 \text{ mm}$$

$$L_1/Lo = \tfrac{2}{3}.$$

Figure 2A:
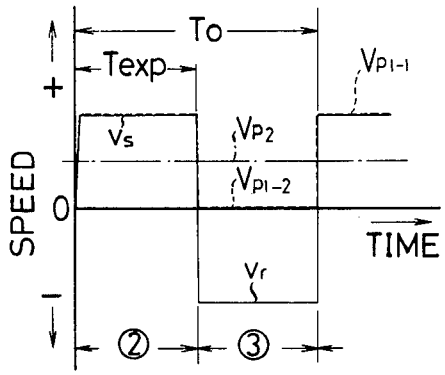
FIGS. 2(*a*) and 2(*b*) are views similar to FIGS. 1(*a*) and 1(*b*) respectively but showing data obtained with the apparatus according to the invention.
Figure 2B:
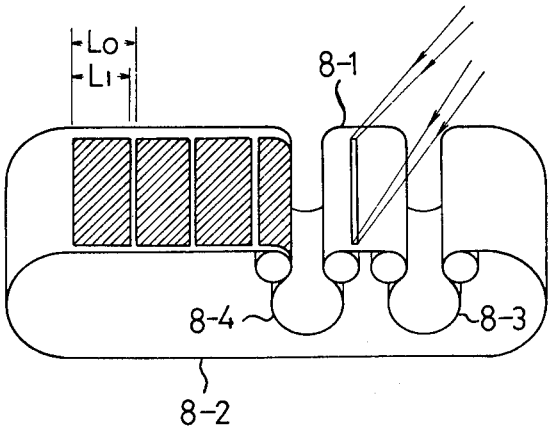
Figure 2C:
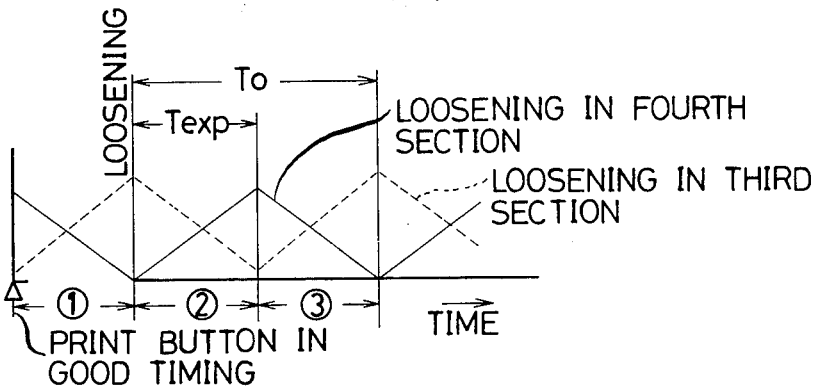

FIGS. 2(*a*) and 2(*b*) are similar to FIGS. 1(*a*) and 1(*b*) respectively but showing the results obtained with the apparatus according to the invention. In FIG. 2(*a*), Vp1 is the speed of the photosensitive member including the exposing section in a first section 8-1 as shown in FIG. 2(*b*), and Vp2 is the speed of the photosensitive member in a second section 8-2 in which other copying processing than exposing is carried out.

As can be seen in FIG. 2(*a*), the speed Vp1 of the photosensitive member in the first section 8-1 is Vp1−1 at the time of exposing and zero or Vp1−2 when the scanning and exposing system returns to the original position. In the example shown, the speed Vp1−2 is zero. The speed Vp2 in the second section 8-2 is a constant speed intermediate between the Vp1−1 and Vp1−2 described hereinabove. To enable the photosensitive member in the form of an endless belt to move alternately at the two speeds of Vp1−1 and Vp1−2 in the first section and to move continuously at a constant speed in the second section, the photosensitive member 8 is provided, as shown in FIG. 2(*b*), with a third section 8-3 and a fourth section 8-4 capable of accommodating loosening of the photosensitive belt substantially in the form of a letter Ω (omega) between the first section 8-1 and the second section 8-2. It is necessary that the length of the loosening of the photosensitive belt be above a value corresponding to the product of the difference between Vp1−1 and Vp2 and Texp which is naturally equal to the product of the difference between Vp2 and Vp1−2 and To−Texp.

The following relation should hold to enable the photosensitive belt 8 to travel in steadystate fashion in the first section 8-1 and the second section 8-2 as aforesaid:

$$\overline{Vp1-1} \cdot Texp + \overline{Vp1-2}(To - Texp) = Vp2 \cdot To \quad (7)$$

To enable images to be formed in the same size as the document, the following relation should hold:

$$\bar{V}_s = \overline{Vp1-1} \quad (8)$$

In the equations set forth above, Vp1−1, Vp1−2 and $\bar{v}_s$ are mean values of Vp1−1, Vp1−2 and $v_s$ respectively.

To enable the scanning means to be restored to its home position, the following relations should hold as is the case with the prior art:

$$\bar{v}_s \cdot Texp = \bar{v}_r (To - Texp) \quad (9)$$

$$Lo = Vp2 \cdot To \quad (10)$$

$$L_1 = \overline{Vp1-1} \cdot Texp \quad (11)$$

When the scanning means returns to its home position, the speed of the photosensitive member in the first section 8-1 is Vp1−2, so that it hardly moves or does not move at all.

Assume that control of the movement of the photosensitive member in the first section 8-1 is effected under the condition:

$$L1/Lo = \frac{Vp1-1 \cdot Texp}{Vp2 \cdot To} \quad (12)$$

Therefore, $$\frac{Vp1-1}{Vp2} > 1$$

Then the following relation holds:

$$L_1/Lo > Texp/To.$$

Thus, as shown in FIG. 2(*b*), it is possible to narrow the gap between the images formed on the photosensitive member.

For example, when copying is performed under the conditions of To=0.8 second (or 75 copies per minute), $L_1$=240 mm (same as the previous example), $v_s$=Vp1−1=600 mm/S, Vp1−2=0 and Vp2=300/S, the following values can be obtained:

$$\bar{v}_s = 600 \text{ mm/second}$$

$$Lo = L_1 = 240 \text{ mm and } L_1/Lo = 1.$$

Thus it will be seen that copying can be carried out with no gap between the images formed on the surface of the photosensitive belt with a low return speed in spite of the duplicating speed being very high.

In this case, the loosening of the photosensitive belt formed in the third section and the fourth section shows changes as shown in FIG. 2(*c*). In the figure, the broken line represents changes in the amount of loosening in the third section, and the solid line indicates changes in the amount of loosening in the fourth section. It will be seen that the amount of loosening gradually decreases in the third section and gradually increases in the fourth section during the exposing time Texp. The tendency described hereinabove is reversed during the return period.

Figure 3A:
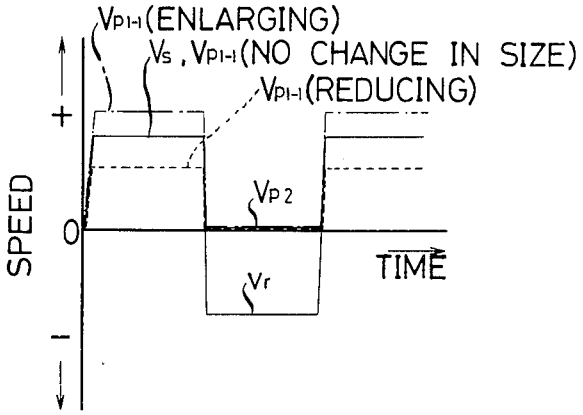
FIG. 3(*a*) is a diagram showing the speed of the scanning section and the speeds of various portions of the photosensitive member in the apparatus according to the invention obtained when copying is effected by varying the multiplication of the copies of the document.
Figure 3B:
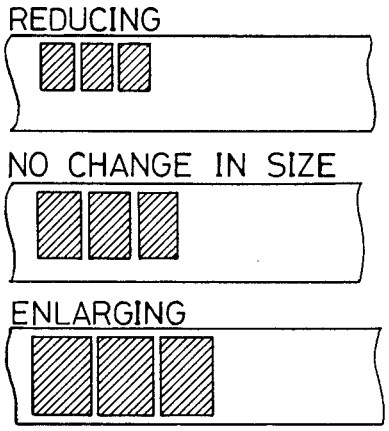

FIG. 3(*a*) shows the speed of the photosensitive member and the speed of the scanning system when copying is effected by varying the size of the copies of the document to be copied. When magnification is m, the speed of the photosensitive member in the first section is $m \cdot v_s$ which is equal to be speed Vp1−1 obtained when copying is effected without varying the size of the copies from that of the document to be copied and which becomes larger than $v_s$ when the size is increased and smaller than $v_s$ when the size is reduced. Vp1−2 is substantially zero, and $v_s$ and $v_r$ are constant in spite of magnification. By substituting $m \cdot v_s$ for the $v_s$ in equation (8), the following relation can be obtained:

$$m \cdot v_s = \overline{Vp1-1} \quad (8')$$

By effecting control in a manner to satisfy the aforesaid equation when other things are equal to those for copying effected to obtain copies of the same size as the document, it is possible to form images on the photosensitive member by varying the size of the images from that of the document to be copied with equal image forming intervals and no gap between the images.

As described hereinabove, it is possible according to the invention to reduce the processing speed other than the exposing speed in spite of the fact that the duplicating speed can be raised, thereby increasing the reserve of processing conditions. It is also possible to reduce the return speed to thereby reduce energy loss, improve safety and reliability and reduce noise. The utilization efficiency of the photosensitive belt increases and the overall duplicating speed of the photosensitive belt rises while its service life can be prolonged. Also the invention enables copying efficiency to be greatly improved because, when copying of the document is effected by varying the size of the document, other processing speed than the exposing speed can be kept constant in spite of the fact that the scanning means of high mass can be operated at a constant scanning speed regardless of the magnification.

The invention will now be described in detail by referring to a first embodiment in which the invention is incorporated in an electrophotographic copying apparatus of the stationary document and moving image forming system type shown in FIGS. 4–6 and a second embodiment in which the invention is incorporated in an electrophotographic copying apparatus of the moving document type shown in FIG. 7.

Figure 4:
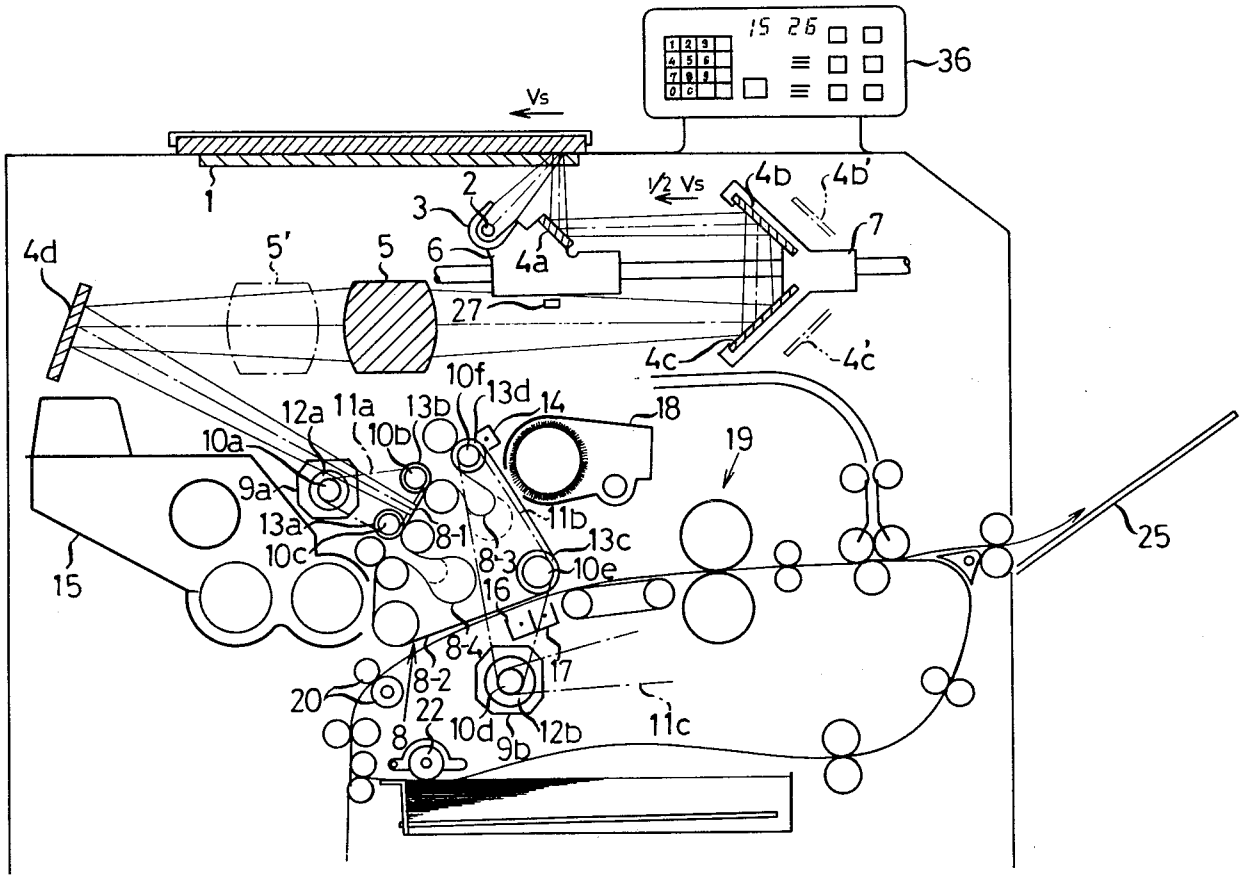
FIG. 4 is a sectional view of the electrophotographic copying apparatus comprising a first embodiment of the invention, shown in its entirety.
Figure 5:
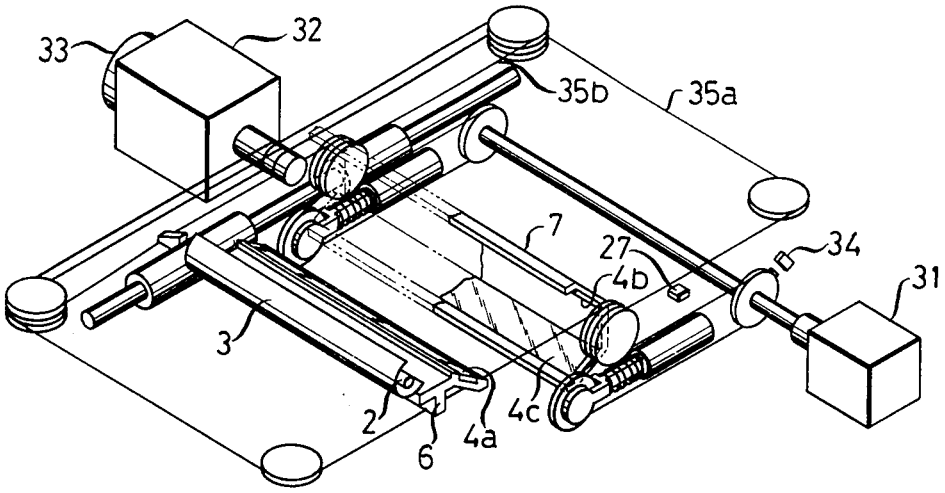
FIG. 5 is a perspective view of the embodiment shown in FIG. 4, showing the magnification varying-scanning mechanism thereof.

In the apparatus shown in FIG. 4, a stationary platen glass plate 1 and an operation panel 36 are located on the surface of a copying apparatus casing. Scanning and exposing means for scanning and irradiating a document placed on a predetermined position on the stationary platen glass plate 1 for forming images of the document on the photosensitive belt 8 comprises an illuminating lamp 2 arranged inside a reflecting shade 3, mirrors 4*a*–4*d* and a lens 5 located between the platen glass plate 1 and an exposing section of the photosensitive belt 8 in optical conjugate relation. The lamp 2, 3 and mirror 4*a* are supported on a first carriage 6, and the mirrors 4*b* and 4*c* are supported on a second carriage 7. In effecting scanning and exposing, the first carriage 6 is moved at a scanning velocity of $v_s$ and the second carriage 7 is moved at a velocity of $\frac{1}{2}$ $v_s$ along a guide bar in parallel to the surface of the document, so that the document can be optically scanned while keeping constant at all times the length of the optical path between the surface of the document illuminated by the lamp 2, 3 and the lens images of the document can be formed in a predetermined position on the photosensitive belt 8 moving along a predetermined path of travel.

When it is desired to change the size of copies to be produced, the second carriage 7 is moved along the guide and the mirrors 4*b* and 4*c* are moved to positions 4*b*′ and 4*c*′ while the lens 5 is moved to a position 5′ shown in dash-and-dot lines in reducing the scale of the copies. In increasing the scale of the copies, the mirrors 4b and 4c are moved in the same direction but to positions different from the positions to which they are moved in reducing the size. The lens 5 is moved to a position in reverse to the position to which it is moved in reducing the size, and then the first carriage 6 and the second carriage 7 are simultaneously moved to effect scanning as is the case with the copying performed to produce copies of the same size as the document. FIG. 5 shows one example of moving means for moving the carriages 6 and 7 for effecting scanning and moving the carriage 7 for varying the size of the copies to be produced. As shown, wires 35a and 35b are trained over a set of pulleys to enable a copy size varying motor 31 to be actuated to move the carriage 7 to the aforesaid position when the size of copies to be produced is varied, and to allow a scanning motor 32 to be actuated to move the first and second carriages 6 and 7 in synchronism with each other in effecting scanning. The numeral 27 designates a carriage home sensor, and the numerals 33 and 34 are an encoder and a mirror home sensor respectively.

Figure 6:
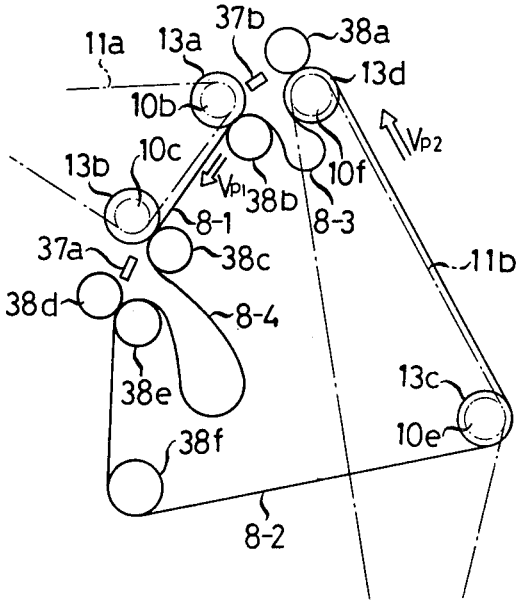
FIG. 6 is a sectional view, on an enlarged scale, showing the vicinity of the photosensitive member of the apparatus shown in FIG. 4.

As shown in detail in FIG. 6, the photosensitive belt 8 is trained over a plurality of guide rolls 38b, 38c, 38e and 38f and capstan rolls 13c and 13d. A pinch roller 38a, a capstan roller 13a, a capstan roller 13b and a pinch roller 38d are in pressing engagement with the rolls 13d, 38b, 38c and 38e respectively. The photosensitive belt 8 has a peripheral length which is greater than the peripheral length required for training the belt taut over the set of rolls by the length of reserve required, as described by referring to FIG. 2, for loosening the belt. The length of reserve of the belt is such that it can be accommodated by loosening the belt in the form of a letter Ω (omega) in the third section 8-4 between the rolls 38c and 38e. The numerals 37a and 37b in FIG. 6 are loosening sensors for the photosensitive belt 8. Slit exposing is performed by the aforesaid exposing system in a predetermined position in the first section 8-1 between the rolls 38b and 38c, and a developer 15, a transfer-printing corona charger 16, a separating corona charger 17 and a cleaner 18 are arranged in the indicated order in the direction of movement of the photosensitive belt 8 indicated by an arrow around the second section 8-2 from the roll 38c to the roll 15d.

Means for feeding the transfer-printing sheets to transfer-printing position formed by the transfer-printing corona charge 16 and means for fixing and discharging the transfer-printing sheets after transfer-printing is effected are no different from the corresponding means of the prior art. In FIG. 4, the numerals 22, 20, 19 and 25 designate sheet feed rollers, resist rollers, fixer and a sheet ejecting tray respectively.

The first section 8-1 of the photosensitive belt 8 between the rolls 38c and 38b is driven alternately at the two speeds of Vp1−1 and Vp1−2 as described by referring to FIG. 2 by first drive means comprising a variable speed motor 9a, a pulley 10a directly connected to a shaft of the motor 9a, a pulley 10b directly connected to the capstan roller 13a, a pulley 10c directly connected to the capstan roller 13b, and a serrated belt 11a. Control of the motor 9a is effected by actuating a switch or pushbutton on the operating panel 36 to produce a speed signal from a control, not shown, so as to rotate the motor 9a at a desired speed of rotation.

The second section 8-2 of the photosensitive belt 8 is driven at a predetermined speed Vp2 by second drive means comprising a constant speed motor 9b, pulleys 10b, 10e and 10f, a serrated belt 11b, capstan rollers 13d and a pinch roller 38a. Back tension means, not shown, is mounted between the rolls 38d and 38e to keep the second section 8-2 of the photosensitive belt 8 in a suitably tensioned condition.

Operation will be described by referring to FIGS. 2, 3, 4 and 6. When copying of a document is effected without varying the size of the copies from that of the document, a print button on the operating panel 36 is depressed. This rotates the motor 9b and energizes the processing means 14-18 around the second section 8-2 of the photosensitive belt 8 until a series of copying operations is completed. Initially the amount of loosening of the belt 8 in the third section and the fourth section is such that, as shown in FIG. 2(*c*), it is greater in the fourth section than in the third section.

In condition ①, a portion of the photosensitive belt 8 charged by a corona charger 14 is stored in the third section 8-3. In condition ②, the motor 9a is actuated and driven at the speed of Vp1−1 and the scanning motor 32 is rotated at the speed of $v_s$, to carry out scanning and exposing. In condition ③, upon completion of exposing, the amount of loosening of the belt 8 is such that it is greater in the fourth section 8-4 than in the third section 8-3.

The motor 9a is deactuated when exposing is completed and the motor 32 is rotated in the reverse direction at the speed of $v_s$ to return the scanning means to its original position. When the scanning means is restored to its original position, the apparatus returns to condition 2, and the same process is repeated until a desired number of copies can be obtained.

By the aforesaid operation, latent images of the document continuously are formed as shown in FIG. 2(*b*) on the surface of the photosensitive belt 8 with a minimum necessary gap therebetween and moved to the second section 8-2 in which developing, transfer-printing and separation are carried out by the processing means located in the second section, so that the transfer-printing sheets separated from the photosensitive belt 8 are fixed by fixing means 19. Then the transfer-printing sheets are delivered to the sheet ejecting tray 25 or a dual surface tray.

When it is desired to produce copies of a document in a size different from the size of the document, the pushbutton on the operating panel 36 is depressed in accordance with the magnification indicated thereon to control the motor 9a in such a manner that Vp1−1 is equal to $m \cdot v_s$ in condition 2. Other operations performed for effecting copying in a size different from the size of the document are similar to those performed for effecting copying in the same size as the document. As a result, enlarged or reduced latent images can be formed on the surface of the photosensitive belt 8 with no gaps therebetween as shown in FIG. 3(*b*), and moved to the second section 8-2.

In the first embodiment shown and described hereinabove, the processing means other than the exposing means are all located in the vicinity of the second section 8-2. However, the corona charger 14 may be located in the first section 8-1.

Figure 7:
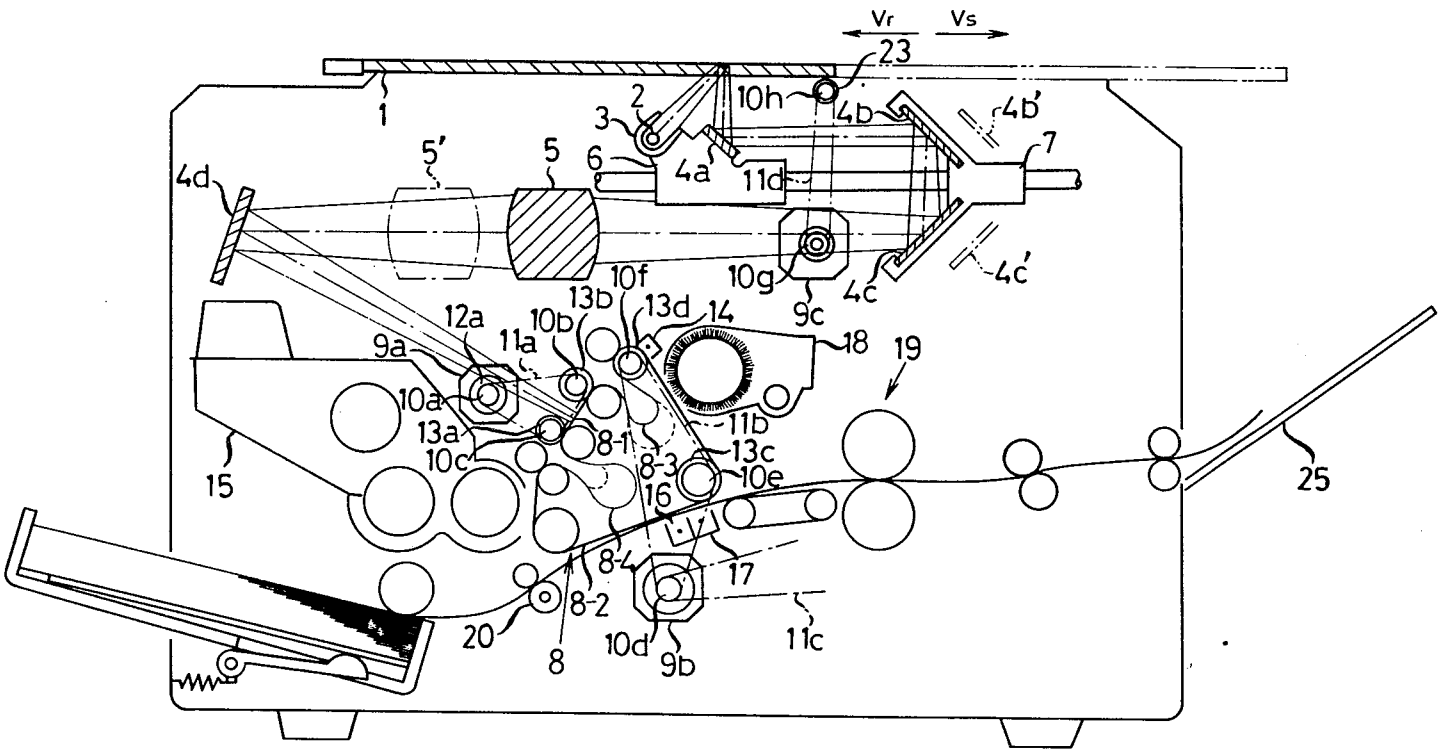
FIG. 7 is a sectional view of the electrophotographic copying apparatus comprising a second embodiment, shown in its entirety.

In the second embodiment shown in FIG. 7, the image forming optical system does not move and the document support 1' reciprocatorily moves at the speed of $v_s$ from left to right when scanning and exposing are carried out, and from right to left at the speed of $v_r$ when it is returned to its original position. Thus the surface of the document is scanned to form an image on the moving photosensitive belt 8 in a predetermined position thereon by exposing it to an optical image of the document. The document support 1' is driven for reciprocatory movement by drive means comprising a pulley 23, a drive motor 9*a*, a serrated belt 11*d*, and serrated pulleys 10*g* and 10*h*. Other parts of the apparatus are substantially similar to those of the first embodiment described hereinabove. Thus the photosensitive belt 8 is driven and the copying processing means are actuated in the same manner as described by referring to the first embodiment.

The invention can achieve effects similar to the effects achieved by the first and second embodiments described hereinabove when incorporated in various types of electrophotographic copying apparatus in which a document is optically scanned by scanning and exposing means to form images of the document in a predetermined position on the photosensitive member in the form of an endless belt by exposing the photosensitive member to an optical image of the document. In particular an apparatus of the system in which a document placed on a stationary document support is scanned by a lens moved at a speed of one-half the speed Vp1−1 at which the exposing section for the photosensitive member moves and images of the document are formed on the surface of the photosensitive member in a predetermined position by exposing it to an optical image of the document.

What is claimed is:

1. An electrophotographic copying apparatus comprising:

scanning and exposing means for optically scanning a document; and a photosensitive member in the form of an endless belt having images of said document formed on its surface in a predetermined position by exposure to an optical image of the document while travelling; wherein the improvement resides in that:

said photosensitive member in the form of an endless belt has a peripheral length which includes a reserve when the photosensitive member is trained over a group of rollers without any loosening, and said photosensitive member in the form of an endless belt is divided into a first section including a predetermined exposing position, a third section and a fourth section connected at one end thereof to opposite ends of said first section and accommodating the reserve in length by loosening the belt, and a second section connected at opposite ends to the other end of said third section and fourth section; and wherein the apparatus further comprises:

first drive means for driving the photosensitive member in the form of an endless belt for moving the photosensitive member in the form of an endless belt in said first section alternately at a high constant speed when scanning and exposing are carried out by scanning and exposing means and at a low constant speed or stopping same when the sensing and exposing means is returned to its original position;

second drive means for moving the photosensitive member in the form of an endless belt in said second section at a constant speed intermediate between said two speeds of high constant speed and low constant speed;

at least one duplication processing means other than the scanning and exposing means located around the second section; and control means for effecting control of said means in a coordinated fashion, so that said reserve in the length of the photosensitive member in the form of an endless belt has a value corresponding to the product of the difference between the speeds at which the photosensitive member in the form of an endless belt is driven to move in the first section and the second section when the scanning and exposing means is returned to its original position and the time required for the return trip thereof.

2. An electrophotographic copying apparatus as claimed in claim 1, wherein said scanning and exposing means comprises an image forming optical system for projecting an image of varied sizes of the document by keeping the surface of the document and the surface of the photosensitive member in the form of an endless belt in the exposing position in conjugate relation, and means for varying the speed of movement of the photosensitive member in the form of an endless belt in the first section during an exposing time depending on the magnification of copies produced.

3. An electrophotographic copying apparatus as claimed in claim 1, wherein said scanning and exposing means comprises an image forming optical system for projecting an image of varied sizes of the document by keeping the surface of the document and the surface of the photosensitive member in the form of an endless belt in the exposing position in conjugate relation, and means for varying the speed of scanning of the scanning and exposing means during an exposing time depending on the magnification of copies produced.

* * * * *